United States Patent [19]

Woodward et al.

[11] Patent Number: 4,891,143

[45] Date of Patent: Jan. 2, 1990

[54] WATER INSOLUBLE ANTISTATIC COMPOSITIONS

[76] Inventors: Fred E. Woodward, 200 Churchill Rd., West Palm Beach, Fla. 33403; Alice P. Hudson, 728 W. Kalmia Dr., Lake Park, Fla. 33403

[21] Appl. No.: 742,848

[22] Filed: Jun. 10, 1985

Related U.S. Application Data

[63] Continuation-in-part of Ser. No. 568,817, Jan. 6, 1984, abandoned, which is a continuation-in-part of Ser. No. 321,742, Nov. 16, 1981, abandoned.

[51] Int. Cl.[4] ..... C11D 1/62; C11D 1/65; C11D 3/28

[52] U.S. Cl. ..... 252/8.75; 252/8.8; 252/545; 252/547; 252/526; 252/528; 252/DIG. 14; 252/542

[58] Field of Search ..... 252/8.75, 8.8, 545, 252/547, 526, 528, DIG. 14

[56] References Cited

U.S. PATENT DOCUMENTS

| | | | |
|---|---|---|---|
| 3,533,942 | 10/1970 | Rhees et al. | 252/8.8 |
| 4,058,489 | 11/1977 | Hellsten | 252/547 |
| 4,173,539 | 11/1979 | Rule et al. | 252/8.8 |
| 4,184,970 | 1/1980 | Draper | 252/8.8 |
| 4,265,772 | 5/1981 | Jones | 252/8.6 |
| 4,272,386 | 6/1981 | Draper et al. | 252/8.6 |
| 4,303,543 | 12/1981 | Mansy | 252/117 |
| 4,342,706 | 8/1982 | Conner et al. | 260/501.15 |
| 4,389,448 | 6/1983 | Green | 428/195 |
| 4,421,792 | 12/1983 | Rudy et al. | 427/242 |

FOREIGN PATENT DOCUMENTS

| | | |
|---|---|---|
| 818419 | 7/1969 | Canada . |
| 2004721 | 10/1971 | Fed. Rep. of Germany . |
| 160890 | 12/1979 | Japan . |
| 62998 | 5/1980 | Japan . |
| 759837 | 10/1956 | United Kingdom . |

*Primary Examiner*— Willis

*Attorney, Agent, or Firm*—Carroll Palmer

[57] ABSTRACT

Compositions which are particulate water insoluble and nondispersible salts of certain surface active sulfate or sulfonate anions and surface active quaternary ammonium cations are described. They are useful as wash cycle laundry softener-antistatic compositions, in both liquid and powdered laundry products and also dispersed in solid matrices. The particle size is from 50 to 500 microns.

19 Claims, No Drawings

WATER INSOLUBLE ANTISTATIC COMPOSITIONS

CROSS REFERENCE TO RELATED APPLICATIONS

This application is a continuation-in-part of co-pending application Ser. No. 568,817, Fred E. Woodward and Alice P. Hudson, for Water Insoluble Antistatic Compositions, filed Jan. 6, 1984, now abandoned which was a continuation-in-part of application Ser. No. 321,742, Fred E. Woodward and Alice P. Hudson, for Water Insoluble Antistatic Compositions, filed Nov. 16, 1981, now abandoned

FIELD OF THE INVENTION

This invention relates to solid particulate laundry softener-antistatic compositions formed when water solutions or dispersions of certain surface active sulfate or sulfonate salts are mixed with water solutions or dispersions of certain surface active quaternary ammonium salts, and the resulting electrically neutral water insoluble and nondispersible undissociated organic salts are isolated in a particulate form substantially free from other components. These compositions have surprising substantivity to fabrics when added to the laundry wash cycle, producing substantial softening and antistatic effects which are unexpected from an uncharged molecule since the prior art teaches that a net cationic charge is necessary to impart substantivity to softener-antistatic compositions. The size of the particles is less than 500 microns, and preferably between 50 and 400 microns.

The quality of softness of laundered fabric as used herein is well defined in the art and refers to the quality of a treated fabric whereby its texture is smooth, pliable, and fluffy. The use of modern heavy duty laundry detergents tends to leave laundered clothes with an undesirable harshness due partly to the deposition of Ca and Mg carbonates, phosphates, etc, on the clothes. It is an object of this invention to provide a composition that will restore a soft pliable texture to laundered clothes.

Another problem encountered in laundering clothes, particularily of a mechanical dryer is used, is that of static cling, which is defined in the art as the tendency of laundered and dried fabric, especially synthetic fabric such as nylon and polyester, to cling to itself and to the walls of the dryer due to the build-up of static electrical charges. When the fabric possesses static electrical charges it tends to attract lint and dust and furthermore is uncomfortable to wear. It is an object of this invention to provide a composition which will dissipate the static charge on laundered and dried fabric.

Quaternary ammonium salts containing fatty alkyl groups have traditionally been used in household laundry softeners because they are substantive to the laundered fabric and provide both softening and control of static cling. However, they are incompatible with anionic detergents which severely restricts their use in the wash cycle. They are also incompatible with optical brighteners and proteolytic enzymes which are commonly incorporated into detergents and detergency boosters used in the wash cycle. The use of quaternary ammonium salts in the rinse cycle necessitates an extra trip to the washing machine to add the softener at the appropriate time. It is a further object of this invention to provide a variety of products with softening and antistatic activity, including liquid or powdered detergents; dry bleaching products containing perborates, dry chlorine compounds, percarbonates, or peroxyacids; products for boosting detergency containing sodium tetraborate, surfactants, enzymes, optical brighteners, and the like; and liquid or powdered wash cycle softener-antistatic compositions which can be added at the beginning of the wash cycle, thus eliminating the inconvenience of adding softener to the rinse cycle.

DESCRIPTION OF THE PRIOR ART

Many methods have been proposed to render quaternary ammonium softener compositions compatible with detergents containing anionic surfactants in the laundry wash cycle.

U.S. Pat. No. 4,184,970 discloses a wash cycle laundry softener composition in which particles or prills containing a quaternary ammonium salt are sprayed with a solution of an "anionic complexing component", which can be an anionic synthetic surfactant including water soluble salts of organic sulfuric acid reaction products. Optionally, the particles or prills and the complexing component can be admixed as solids and sprayed with water. This procedure, however, only partially complexes the quaternary ammonium salt, and the presence of the counterions from the two components causes the particles to disperse to an undesirable extent in the wash water. Also, since these prills are not homogeneous, their effectiveness depends on maintaining the physical integrity of the particle throughout the wash cycle. It is a further object of this invention to provide a homogeneous composition which because of its homogeneity does not depend on maintaining a layered structure in the original particles to be effective.

U.S. Pat. No. 3,703,480 discloses the use of aminopoly-ureylene resins mixed with quaternary ammonoum salts to form a detergent compatible softener. U.S. Pat. No. 3,626,891 discloses certain mixtures of quaternary ammonoum salts which are detergent compatible. Surfactant sulfates and sulfonates and quaternary ammonium salts have been combined in various ways in laundry softener compositions. U.S. Pat. No. 4,184,970 has been described above. U.S. Pat. No. 4,058,489 concerns softener quaternary ammonium compounds and anionic surfactants combined in molar ratios of anionic surfactant to quaternary ammonium salt of 0.6 to 1 to 0.95 to 1 and kept dispersed with a nonionic or an amphoteric surfactant. U.S. Pat. No. 3,644,203 concerns combinations of a fatty alcohol-fatty alcohol sulfate complex with softener quaternary ammonium salts. The resulting softener compositions must be used in nonionic detergents or in rinse cycle softeners. U.S. Pat. No. 4,000,077 concerns combinations of softener quaternary ammonium salts and fatty alcohol sulfates in weight ratios of 10 to 1 to 2 to 1, useful as rinse cycle softeners. U.S. Pat. No. 4,173,539 relates to fatty monoalkyl quaternary ammonium salts and anionic detergents in aqueous suspension used as rinse cycle softeners. U.S. Pat. No. 4,255,294 concerns "complexes" of quaternary ammonium salts and anionic detergents as wash cycle softeners. The molar ratio of anionic detergents to quaternary ammonium salt is from 1.2 to 1 to 12 to 1, and a nonionic detergent is included as a dispersant. Canadian Pat. No. 818,419 discloses the formation of an "electro-neutral complex" formed by combining a cationic textile softening agent with an anionic surfactant in the presence of a nonionic-cationic dispersing agent. The softening activity of this electro-neutral complex depends on a cationic environment, and thus is not operable with all detergent systems, especially those based on anionic surfactants. Further, the "electro-neutral complex" cannot be isolated in a form substantially free from other components which could be sold as an article of commerce, or admixed with other products to add softening and antistatic activity. Japanese Pat. No. JA 0062998 is directed to a granular detergent composition containing a softening composition which is the reaction product of a di-long chain alkyl quaternary ammonium compound and an anionic surfactant which is an alkyl sulfate or an alpha olefin sulfonate, the particle size of which is from 0.01 to 30 microns. Particles of this size are very difficult to isolate in a dry particulate form, and are not effective in liquid products. It is an object of this invention to provide a softener antistat composition that is effective in many forms of laundry products including liquid detergents and other liquid products. U.S. Pat. Nos. 3,431,265 and 3,535,039 describe compositions formed by mixing a biologically active quaternary ammonium compound with a surfactant sulfate or sulfonate which contains a glyceryl moiety or a polyether moiety. These mixtures result in compositions which are water dispersible and possess no textile softening activity. All of these softener compositions depend for their softening and antistatic activity on their being effectively dispersed, either through the use of an excess of one of the charged components, i.e. the softener quaternary ammonium salt or the anionic detergent or surfactant, or through the use of a nonionic or an amphoteric surfactant as a dispersant. Further those which are proposed as wash cycle products depend for their effectiveness as detergents on a very careful selection of detergent surfactant which will be compatible with the dispersed softeners. An object of this invention is to provide a softener antistatic composition that remains a separate, solid phase during the wash cycle and the rinse cycle, and spreads on the clothes to provide softening and static protection as the clothes are dried in a mechanical dryer. It is a further object to provide a composition that, because it is a separate, solid phase, does not interact with the detergent surfactants and thus is compatible with all surfactant systems and detergent components, thus eliminating or easing most of the prior restriction on formulating products with softeners to be used in the wash cycle. It is a further object to provide a softener-antistatic composition which is a single chemical compound and is effective in a pure form without a requirement for dispersants, dispersion inhibitors, specially formulated detergents and the like.

SUMMARY OF THE INVENTION

We have discovered that by forming a solid, particulate, water insoluble organic salt of a surface active sulfate or sulfonate anion and a surface active quaternary ammonium cation in which the resultant particle size is preferably from 50 to 500 microns by methods herein described there results a composition which is a superior laundry softener and antistatic agent which is compatible with all detergent surfactant systems. These compositions are not complexes, nor are they mixtures of cationic salts and anionic surfactant salts, but are distinct chemical compounds which are neither anionic nor cationic in nature. They are undissociated organic salts, or "ion pairs" with no water soluble components. They are distinguished from quaternary ammonium halides, sulfates, phosphates, acetates, and the like in that the compounds of this invention do not dissociate at all in water. They are distinguished from the systems of the prior art in that they are performed and isolated as pure compounds, dried, and put into particles of the desired size. By doing this the insoluble organic salt becomes surprisingly much more effective as a softener-antistatic agent, and also becomes inert to the other components of the detergent or other laundry product with which it is used. Without being held to theory, we believe that we have modified the size, hardness, and surface properties of the particles of the softener so that they both remain intact and undispersed in the wash liquor throughout the wash cycle and also tend to attach themselves to the fabric in the wash in a manner unaffected by the surfactants present.

DETAILED DESCRIPTION OF THE INVENTION

This invention relates to particles of an undissociated organic salt which results when a surface active water soluble or dispersible sulfate or sulfonate salt is chemically combined with a surface active water soluble or dispersible quaternary ammonium salt in about stoichiometric ratio and under conditions of intimate mixing, preferably in a water medium, and the organic phase which forms is separated from the water phase in dry particulate form substantially free from other ingredients, and in particles between 50 and 500 microns in size. Thus we have discovered that by isolating this water insoluble organic phase under conditions such that the counter-ions of the sulfate or sulfonate surfactant and the quaternary ammonium surfactant are removed in the water phase and then purifying, drying, and grinding the insoluble phase, homogeneous water insoluble and under normal laundry conditions nondispersible compositions, which are undissociated organic salts of the sulfate or sulfonate anions and the quaternary ammonium cations, result. Since the nondispersibility of the particles of this invention is vital to their function, we define nondispersibility in a functional way as being able to recover essentially unchanged in size and shape the particles of softener after the wash liquor containing detergent and softener has been agitated in a simulated wash cycle to which no fabric is added. This can be accomplished with standard seives and examination of the isolated particles with a magnifying glass. These compositions, when added to the laundry wash cycle as particles between 50 and 500 microns in size are effective softener antistatic agents when the clothes are subsequently dried in a mechanical dryer.

The compositions of this invention are chemical compounds in the classical sense in that they have a precise weight ratio of components. They are water insoluble and nondispersible undissociated ion pairs of a surface active quaternary ammonium cation and a surface active sulfate or sulfonate anion of the structure:

$$R_1R_2R_3R_4N^{+}{}^{-}OSO_2(O)_xR_5 \qquad \text{(i)}$$

wherein

- $R_1$ is an alkyl, alkenyl, alkoxyalkyl or acylamidoalkyl group containing about 12 to 22 carbon atoms with the alkyl radical of the acylamidoalkyl being ethyl or propyl;
- $R_2$ is $R_1$, hydroxyethyl, hydroxypropyl, ethyl, or methyl;
- $R_3$ and $R_4$ are methyl, ethyl, propyl, hydroxyethyl, hydroxypropyl or benzyl;
- $R_5$ is an alkyl, alkenyl, alkaryl or monohydroxyalkyl group containing about 10 to 22 carbon atoms; and x is 0 or 1; or ii.

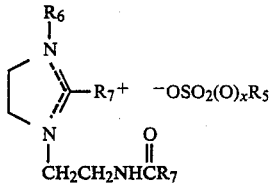

wherein $R_6$ is methyl or ethyl;

$R_7$ is alkyl or alkenyl containing about 14 to 22 carbon atoms; and $R_5$ and x are as defined above.

The anionic portion of the ion pair is derived from surfactant sulfate or sulfonate salts included in the group consisting of $$R—SO_4^-$$

wherein R is an alkyl or alkenyl group containing 10 to 22 carbon atoms, and is preferably an alkyl group containing about 10 to 20 carbon atoms, and is most preferably a straight chain alkyl group containing about 12 to 20 carbon atoms; and $$R'—SO_3^-$$

wherein R' is an alkyl, alkenyl, alkyl aryl, or hydroxyalkyl group containing about 10 to 22 carbon atoms.

Since the ion pair product no longer contains the original cation associated with the sulfate or sulfonate anion except as a minor impurity, its choice is one of convenience. It must, however, dissociate from the sulfate or sulfonate anion to a substantial extent in water. Suitable cations include $Na^+$, $K^+$, $Li^+$, $NH_4^+$, ethanol ammonium, diethanol ammonium, triethanol ammonium, and other water soluble amines. Less suitable are $Mg^{++}$ and $Ca^{++}$ which usually do not dissociate sufficiently.

Suitable surfactant alcohol sulfate salts include sodium stearyl sulfate, sodium cetyl sulfate, sodium myristyl sulfate, sodium lauryl sulfate, sodium decyl sulfate, sodium oleyl sulfate, sodium linoleyl sulfate, and sodium tallow sulfate, and the corresponding ammonium and potassium salts. These products are well known in the art and are readily available from many sources. Especially preferred alcohol sulfates are those of alcohols derived from hydrogenated tallow or hydrogenated vegetable oil.

Sulfonates useful in this invention include these which result from the reaction of alpha olefins containing 10 to 22 carbon atoms with sulfur trioxide. The product of this reaction is a mixture of isomers of alkenyl sulfonates and hydroxyalkyl sulfonates of the structures $$R''—CH{=}CH—CH_2SO_3H$$

$$R''—CH_2—\underset{\underset{OH}{|}}{CH}—CH_2SO_3H$$

in which R'' is alkyl containing 7 to 19 carbon atoms; which are neutralized with alkali metal hydroxides to the corresponding alkali metal sulfonate salts.

Also included are alkylaryl sulfonates resulting from the reaction of $C_8$ to $C_{18}$ alkyl benzenes and naphthalenes with sulfur trioxide, of the structure $$R'''—Y—SO_3H$$

wherein R''' is alkyl containing 8 to 18 carbon atoms and Y is phenyl or naphthyl, which are neutralized with alkali metal hydroxides to the corresponding alkali metal sulfonate salts.

Paraffin sulfonates of the structure $$H(CH_2)_m\underset{\underset{SO_3H}{|}}{CH}(CH_2)_nH$$

wherein m and n are integers from 0 to 21 and m+n is 9 to 21; made by the sulfoxidation of n-paraffins are also included.

The cationic portion of the ion pair is derived from quaternary ammonium salts whose cationic portions are of the structure:

$$R_1R_2R_3R_4N^+ \qquad \text{(i)}$$

wherein $R_1$ is an alkyl, alkenyl, alkoxyalkyl or acylamidoalkyl group containing about 12 to 22 carbon atoms with the alkyl radical of the acylamidoalkyl being ethyl or propyl;

$R_2$ is $R_1$, hydroxyethyl, hydroxypropyl, ethyl, or methyl;

$R_3$ and $R_4$ are methyl, ethyl, propyl, hydroxyethyl, hydroxypropyl or benzyl; and ii.

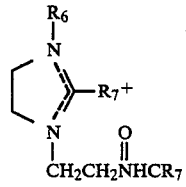

wherein $R_6$ is methyl or ethyl, and $R_7$ is alkyl or alkenyl containing about 14 to 22 carbon atoms.

Cations of the first structure are preferred, and are most preferred when $R_1$ and $R_2$ are $C_{16}$ to $C_{20}$ alkyl and $R_3$ and $R_4$ are methyl or ethyl.

Since the ion pair product no longer contains the original anion associated with the quaternary ammonium cation except as a minor impurity, its choice is one of convenience. It must, however, dissociate from the quaternary ammonium cation to a substantial extent in water. Suitable anions include $Cl^-$, $Br^-$, $I^-$, methosulfate, ethosulfate, $SO_4^=$, $NO_3^-$, acetate and other anions which dissociate in water.

Suitable quaternary ammonium salts include distearyldimethyl ammonium chloride, cetyltrimethyl ammonium chloride, ditallow dimethyl ammonium methosulfate, dicocodimethyl ammonium chloride, stearamidopropyltrimethyl ammonium chloride, alkyl ($C_{12-16}$) dimethylbenzyl ammonium chloride, tridecyloxypropyl trimethyl ammonium chloride, stearyl di-2-hydroxyethylmethyl ammonium chloride, di(hydrogenated tallow) ethyl imidazolinium ethosulfate, di(hydrogenated tallow) dimethyl ammonium chloride, tallow di-2-hydroxypropyl methyl ammonium chloride, stearyl trimethyl ammonium chloride, and distearamidoethyl dimethyl ammonium chloride.

Another aspect of this invention is to the process for preparing a laundry softener-antistatic composition which is a water insoluble organic salt of a surface active sulfate or sulfonate anion and a surface active quaternary ammonium cation. This process consists essentially of (i) intimately mixing, in any order, from about 40 to 90 parts of water, preferably from about 50 to 80 parts of water with about 10 to 60 parts, preferably about 20 to 50 parts of the combination of (a) a salt of the sulfate or sulfonate anion and a counter-ion which is substantially ionized in water, and (b) a salt of the quaternary ammonium cation and a counter-ion which is substantially ionized in water, the molar ratio of a to b being from about 0.8 to 1 to 1.2 to 1 and preferably being about 1 to 1;

(ii) allowing the mixture to stand at a sufficient temperature for a sufficient period of time such that the water insoluble organic salt of the sulfate or sulfonate anion and the quaternary ammonium cation separates from the water phase in a form such that it is no more than about 60 percent water by weight, and is preferably less than about 40 percent water, and contains no more than about 0.25 moles of the salt of the counter-ions per mole of the ion pair of the sulfonate or sulfate anion and quaternary ammonium cation, and preferably contains less than about 0.1 mole of counterion salt per mole of product organic salt;

(iii) evaporating the trapped water from the sulfate or sulfonate-quaternary ammonium organic salt until it contains less than about 25 percent water by weight, and preferably contains less than about 10 percent water by weight; and (iv) grinding, spray congealing, or otherwise putting the composition in the form of small particles of from about 50 to about 500 microns, and preferably from about 50 to 400 microns in diameter.

Drying can be effected by any of a number of methods common in the art. Examples of suitable methods include the use of a Sandvik belt dryer an the use of a Mazzoni soap dryer. Products which are non-tacky solids can be simultaneously dried and ground in a ribbon blender. A preferred method is spray-congealing, whereby the molten compound are sprayed countercurrently through air to give small, discrete particles, the size of which can be controlled.

The dried product is put into a powder form suitable for adding to the laundry wash cycle by methods known in the art. Hard, non-tacky solids are readily ground to particles from about 50 to 500 microns, and preferably from about 50 to 400 microns in diameter, or they may be melted and spray-congealed into prills of this size. Preferred products have sintering points from about 35° to 120° C., and more preferred products have sintering points from about 55° to 100° C.

An especially useful physical form of the compositions of this invention is an entrapped particles in a water soluble or dispersible solid organic material. This allows one to use the physical properties of the solid organic material, such as extrudability, moldability, detergency, and the like to make tablets, bricks, flakes, particles in any size (larger than the 50 microns of the softener) and other useful configurations. The physical properties of the organic material remain essentially unchanged, because the softener particles are only slurried into the mixture, and remain as a separate solid phase. These compositions can be prepared in a number of ways. The organic material can be dissolved or dispersed in water, and the softener particles of this invention can be mixed in. The water is evaporated from the resulting slurry at a temperature below the sintering point of the softener, and the resulting composition is a solid material with the physical properties of the solid organic material. If the organic material has a melting point less than the sintering point of the softener particles, it can be melted and the softener particles mixed in. The composition is then molded, extruded, flaked, cooled and ground, or otherwise put into the desired configuration.

Useful organic materials for these products include a large number of compounds. In general they must be suitable for use in the laundry products in which they are to be incorporated; that is, they must be compatible with surfactants, builders, and other detergent ingredients, and must offer no hazard to the housewife, the clothes, or the laundry equipment. It is preferred that they also have beneficial effects in and of themselves, such as enhanced detergency. More specifically, they include 1. Ethoxylated materials with sufficient polyethylene oxide to render them water soluble and solid at room temperature.

Examples are:

polyethylene glycol of molecular weight greater than 1000 nonionic surfactants which are aliphatic alcohols, alkyl phenols, polypropylene glycols, alkyl amines, acyl amides or fatty acids condensed with sufficient ethylene oxide so that they melt above about 35° and are water soluble. Commercial products include:

Pluronics F38, F68, F77, F87, F98, F108, F127, which are ethoxylated polypropylene oxides from BASF Wyandotte;

Igepals CO-880, CO-890, CO-970, CO-990, DM-880, and DM-970, which are ethoxylated nonyl and dinonyl phenols from GAF Corp.;

Brij 35, 58, 78, and 97, which are ethoxylated alkyl alcohols from ICI United States, Inc.;

Myrj 52 and 53, which are polyethylene glycol esters of fatty acids from ICI United States, Inc.;

Ethomeen 18/60 and Ethomid HT/60, which are an ethoxylated fatty amine and an ethoxylated fatty amide from Armak.

2. Anionic, nonionic, or amphoteric surfactants which are water soluble or dispersible, and are solid materials when evaporated to dryness. Examples are:

Sodium lauryl sulfate
Sodium Myristyl sulfate
Sodium cetyl sulfate
Lauroyl diethanol amide
Myristyl dimethyl amine oxide
Monoethanol ammonium stearate
Diethanol ammonium stearate
Triethanol ammonium stearate
Sodium tallowyl isethionate
Sodium alpha olefin sulfonate
Cocobetaine
Stearamidobetaine
Sodium cocoate Mixtures can also be used. The weight ratio of softener particles to solid organic material is from about 1 to 10 to about 4 to 1, and is preferably from about 1 to 10 to about 1 to 1.

The compositions of this invention effect good static protection and softening with all types of laundry products in common use. They are effective in built detergent powders based on polyphosphates, NTA, sodium carbonate, or zeolites, and containing nonionic, anionic, and amphoteric surfactants. They can either be incorporated into the powder or added separately to the washing machine. They can be formulated into liquid laundry detergents where they remain as particles and retain their excellent softening and antistatic properties. Since they do not dissolve or disperse they do not interfere with builders, surfactants, brighteners, enzymes, or other adjuvants. They are well suited to special laundry products, such as dry bleaches containing sodium perborate, sodium percarbonate, sodium dichloroisocyanurate, magnesium monoperoxyphthalate, or other dry bleaches; and liquid powdered detergency boosters containing surfactants, builders, enzymes, optical brighteners, bleaching agents, and other adjuvants.

It will be recognized that these compositions can be used in the rinse cycle of the laundry operation. They can be added as powders or less preferably can be added as a dispersion of particles. They can also be applied in the dryer, where they have the advantage of being noncorrosive. For dryer application melting point modifiers, substrates and other modification common in the art may be used.

It is understood that other adjuvants commonly added to laundry softener compositions, such as perfumes, dyes, and the like, can be incorporated into the compositions of this invention.

Our invention is further illustrated by the following examples.

EXAMPLE 1

Standard methylene blue titrations were used to determine the equivalent weights of a 45% paste of sodium tallow alcohol sulfate (Avirol T-45, from Henkel Corporation) and a 75% alcohol dispersion of di(hydrogenated tallow) dimethyl ammonium chloride (Adogen 442, from Sherex Chemicals). The equivalent weight per surface active sulfate group of the as is paste of Avirol T-45 was 1100; the equivalent weight per surface active ammonium group of the as is dispersion of Adogen 442 was 766.

55 g of Avirol T-45 (0.5 moles) was mixed with 38.4 g of Adogen 442 (0.05 moles) and 100 g of water was added. The mixture was heated to 60° C., then stirred for 30 minutes at 60°–70° C. A water phase separated from an emulsion phase when agitation stopped; on standing about 2 hours at 70° C. the emulsion broke and the organic phase was nearly clear. The composition was cooled to room temperature, at which temperature the organic phase was very hard and the water phase could be decanted readily. The organic phase weighed 62.7 g and contained 21.5% water by weight. It was broken into small lumps and spread in a thin layer to evaporate the remaining water. When it contained less than 5% water it was ground to a fine, non-tacky powder in a Waring Blender and screened through a 40 mesh seive. To show that the composition of this example had neither cationic nor anionic character, 0.1 g. of the dried powder was dissolved in 10 ml of methylene chloride, and 5 ml of 1N $H_2SO_4$ and 5 ml of methylene blue indicator solution were added. The mixture was shaken vigorously and the layers were allowed to separate. The methylene blue was the same intensity in both layers. If an excess of quaternary ammonium salt were present the methylene blue would have all remained in the water phase; if an excess of tallow sulfate were present, the methylene blue would have been in the methylene chloride only. Therefore the composition of this example has no net cationic or anionic functionality.

The product was tested as a wash cycle softenerantistat by the following method: 8 lbs. of mixed soiled clothes containing about equal portions of synthetic fabric (nylon, polyester and acrylic), permanent press fabrics (cotton-polyester blends) and cotton fabrics were placed in a 20 gal capacity automatic washer and the washer was filled with 100 ppm hard water at 40° C. 100 g a powdered detergent containing 6.1% phosphorus and nonionic and anionic surfactants, and the stated quantity of the softener-antistat of this example were added as the washer started agitating. The washer completed its cycle of a 10 minute wash, spin, room temperature rinse, and final spin to about 50% moisture pickup. The clothes were dried in an electric hot air dryer using a 40 minute heat cycle plus a 5 minute cool-down cycle. Static was evaluated visually by a trained observer and was rated 0 if no static could be detected, + if static was just detectable, ++ if static was present but judged to be less than that produced by using the detergent alone, and +++ if there was no reduction from the detergent alone. A rating of + is acceptable; a rating of 0 is of course preferred.

Hand was evaluated on a cotton terry cloth towel and was rated on a scale of 1 to 4, in which a ranking of 1 is the equivalent of using a quaternary ammonium softener in the rinse cycle, and 4 is the equivalent of the detergent alone. A ranking of about 2.5 is acceptable, lower rankings being preferred.

Results from testing the composition of Example 1 are shown in Table 1. At 4.5 g per 8 lb. of laundry, static was eliminated and the hand was excellent. At 3 g per 8 lb. of laundry the static was just detectable and the hand hand was still very good.

TABLE 1

Softening and antistatic activity of the composition of Example 1.

| Quantity of composition of Example 1 added to 8 lb of laundry, g | Static | Hand |
|---|---|---|
| 4.5 | 0 | 1 |
| 3 | + | 2 |

EXAMPLE 2

Compositions were prepared by the procedure of Example 1, except that the molar ratio of sodium tallow alcohol sulfate to dihydrogenated tallow dimethyl ammonium chloride was varied.

Composition A: 55 g of Avirol T-45 (0.05 moles) was mixed with 28.7 g of Adogen 442 (0.0375 moles) and 100 g of water. The water phase which separated was cloudy, and contained about 4 percent of the added sodium tallow alcohol sulfate. The dried product was a non-tacky powder.

Composition B: 55 g of Avirol T-45 (0.05 moles) was mixed with 52.5 g of Adogen 442 (0.069 moles) and 100 g of water. A clear water phase that contained no surfactant separated. The dried product was a non-tacky powder.

Compositions A and B were tested by the method described in Example 1. The results are shown in Table 2. Composition A, with excess sodium tallow alcohol sulfate had both unacceptable static and softening at 4.5 g per 8 lb. of laundry. Composition B eliminated static but was less effective as a softener than was the mole/-mole product of Example 1.

TABLE 2

| Softener added to 8 lb. of laundry | Static | Hand |
|---|---|---|
| 4.5 g of Composition A | ++ | 3 |
| 4.5 g of Composition B | 0 | 2 |

EXAMPLE 3

The organic salts listed below were prepared by the method of Example 1, and were tested as laundry wash cycle softeners. All were effective as softeners and all showed antistatic activity.

A. Di(hydrogenated tallow) dimethyl ammonium cetyl-stearyl sulfate
B. Di(hydrogenated tallow) dimethyl ammonium $C_{12-15}$ alkane sulfonate
C. Di(stearamidoethyl)dimethyl ammonium $C_{16-18}$ alpha olefin sulfonate
D. Tallow trimethyl ammonium $C_{12-14}$ alpha olefin sulfonate
E. Ditallow methyl imidazolinium dodecyl benzene sulfonate
F. Di(hydrogenated tallow)methyl imidazolinium tallow alcohol sulfate
G. Bis(hydrogenated tallowamidoethyl)-2-hydroxyethyl methyl ammonium tallow alcohol sulfate
H. Di(hydrogenated tallow)dimethyl ammonium $C_{10}$ alpha olefin sulfonate To show that the softener-antistat obtained in a particulate form substantially free from other ingredients is superior to a composition formed in situ in the wash liquor, the following detergents were prepared:

| Ingredient | Composition A | Composition B |
|---|---|---|
| | (parts by weight) | |
| Sodium tripolyphosphate | 40 | 40 |
| Soda ash | 41.4 | 41.4 |
| Sodium silicate pentahydrate | 5 | 5 |
| Sodium tetraborate pentahydrate | 1 | 1 |
| Sodium carboxymethyl cellulose | 1 | 1 |
| Linear alcohol ethoxylate | 7 | 7 |
| Sodium alkylbenzene sulfonate (90%) | 1.5 | |
| Di(hydrogenated tallow)dimethyl ammonium chloride (75%) | 3 | |
| Composition of Example 1 | | 3.6 |

To show the difference in the physical nature of the compositions 0.6 g of detergent was added to 300 g of tap water at 49° C. stirring with a slight vortex. After 90 seconds the detergent solutions were poured through a 9 cm circle of black percale in a Buchner funnel, and particles trapped on the fabric were noted. Composition A left a very few large particles that were undissolved quaternary ammonium salt. Composition B left many small uniform particles. When viewed at 10x magnification, they appeared to be no different in size and shape from the softener powder added to the detergent. The softening and antistatic activity of the two compositions was tested by the procedure of Example 1. Static produced on synthetic fabrics in the dryer was measured with an electrostatic voltmeter. The average charge from the load washed with Composition A was 4.1 Kv; that of the load washed with Composition B was 3.7 Kv. The hand of the cotton terry towels from Composition A was rated 3.7; those from Composition B rated 3.2.

Liquid detergency boosters designed to be added with a detergent to the laundry wash cycle possessing softening and antistatic activity can be prepared by mixing suitable surfactants, optical brighteners, enzymes, builder salts, polymers, and the particulate softener-antistatic compositions herein described. Such compositions can contain from about 5% to 50% of one or more nonionic, anionic, or amphoteric surfactants; from 0 to about 1% optical brighteners; from 0 to about 12% enzymes; from 0 to about 20% builder salts such as sodium tripolyphosphate, tetrapotassium pyrohosphate, sodium carbonate, sodium citrate, borax, and the like; from 0 to about 5% of a polymeric antiredeposition agent such as carboxymethyl cellulose, sodium polyacrylate, polyvinylpyrrolidone, and the like; and from about 2% to 35% of one or more particulate softener-antistatic agents herein described; the balance being water or one or more mono or dihydric alcohols containing about 2 to 3 carbon atoms, or mixtures thereof. In these compositions the softener-antistatic agent is present as particles.

EXAMPLE 5

A product to be used with laundry detergents as a detergency booster-softener-antistat combination was prepared by mixing 15.4 g of tallowoyl isethionate (67%), 5 g of a 10% solution of polyvinylpyrrolidone, 4 g of a 5.25% solution of optical brightener in 25% ethanol, 160 g of water, and 15.8 g of the composition of Example 1. The same composition was prepared without the softener-antistatic composition of Example 1. Both products were tested by the procedure in Example 1, using 57 g (¼ cup) of the detergency booster product with 100 g of a powdered non-phosphate anionic detergent. Static charge in the synthetic fabrics was measured with an electrostatic voltmeter, and was found to be reduced by ½ by adding the softener-antistat (first composition above) from that of the composition without the softener-antistat. The hand was also substantially improved by adding the softener-antistat. After the composition had stood for 16 months a sample was screened through a 200 seive. Particles of the softener were retained on the screen, and thus were shown to have remained intact in the liquid composition.

Powdered detergency boosters designed to be added with a detergent to the laundry wash cycle possessing softening and antistatic activity can be prepared by mixing suitable surfactants, bleaches, enzymes, optical brighteners, builder salts, polymers, and other adjuvants, and the particulate softener-antistatic compositions herein described. Such compositions may contain from 0 to about 80% of one or more nonionic, anionic, or amphoteric surfactants; from 0 to about 30% of a powdered bleach such as sodium perborate, sodium percarbonate, peroxy organic acids, dry chlorine containing compounds, and the like; from 0 to about 12% enzymes; from 0 to about 1% optical brighteners; from 20 to about 98% builder salts such as condensed phosphates, borax, sodium carbonate, zeolites, trisodium nitrilotriacetate, and the like; from 0 to about 5% of an antiredeposition polymer such as sodium carboxymethyl cellulose, sodium polyacrylate and other polycarboxylates, and the like; and from about 2% to 50% of one or more of the particulate softener-antistatic compositions herein described.

EXAMPLE 6

To prepare a detergency booster-softener-antistat product in a powdered form, 12 g of dinonylphenol condensed with 150 moles of ethylene oxide (m.p. 60° C.) was warmed to 65° C., and 6 g of the composition of Example 1 was mixed in thoroughly. The mixture, containing particles of the softener-antistat in the molten nonionic surfactant, was allowed to cool to room temperature and was ground in a Waring blender and screened through a 20 mesh seive. Using the same quantities of softener-antistat and nonionic surfactant another composition was prepared and heated to 95° C. at which temperature the softener-antistat was also molten, so that the particles were destroyed and the product was dispersed in the nonionic surfactant. It was mixed, cooled, and ground in the same way as the previous composition.

To test, 13.5 g (6 g of nonionic and 4.5 g of softener-antistat) of the products were added with 100 g of a non-phosphate anionic powdered detergent to the wash cycle. The first composition, in which the softener particles remained intact showed a large reduction in static from the detergent alone, and the hand effect was rated 2.5. The second composition in which the softener was melted into the nonionic surfactant showed a marginal reduction in static and a hand effect rated 3.8. This demonstrates that to obtain softening and antistatic effects from the compositions of this invention it is necessary for the particles of softener to remain intact in the laundering process.

EXAMPLE 7

The composition of Example 1 was mixed with sodium tetraborate decahydrate (borax) at a ratio of 3.5 parts of softener to 96.5 parts of borax, to prepare a detergency booster with softening and antistatic activity. It was tested by the procedure of Example 1 for ten cycles. Static was rated 0 for each of the 10 cycles. There was no yellowing of white fabrics in the load as evidenced by no change in the reflectance measured with a Gardener reflectometer.

EXAMPLE 8

The particles of this invention can be suspended in liquid laundry detergents to obtain detergent-softener-antistat compositions. The following detergents were prepared:

| Ingredient | Composition A | Composition B |
|---|---|---|
| | (parts by weight) | |
| Linear alcohol ethoxylate | 25 | 25 |
| Composition of Example 1 | 5 | |
| Avirol T-45 (see Example 1) | | 5.2 |
| Adogen 442 (see Example 1) | | 3.6 |
| Water | 70 | 66.2 |

The "black cloth test" of Example 4 was used to show that the softener particles in Composition A remained intact in the wash liquor, and that no particles were present in the wash liquor from Composition B. The two compositions were tested as detergent-softeners by the procedure of Example 1. Static generated on synthetic fabrics in the dryer was measured with an electrostatic voltmeter. The average charge in the load washed with Composition A was 2.4 Kv; the average charge from Composition B was 3.8 Kv. The hand of the terry towels washed with Composition A was rated superior to that of the towels washed with Composition B. The detergency of Composition A can be improved by the incorporation of a proteolytic enzyme. Since the softener particles are uncharged, and furthermore remain intact throughout the wash cycle, the softener does not interfere with the activity of the enzyme.

EXAMPLE 9

A. Di(hydrogenated tallow)dimethyl ammonium lauryl sulfate was prepared by mixing 76.9 g (0.1 mole) of Adogen 442, 96.0 g (0.1 mole) of a 30 percent water solution of sodium lauryl sulfate and 100 g of water, and warming with stirring. A stiff paste separated from a clear water phase. The water was decanted, and the product containing 55 percent water was air dried to less than 5 percent moisture at ambient temperature. It was ground in a Waring Blender and screened through a 40 mesh seive. The particle size was determined to be greater than 95 percent between 50 and 400 microns.

B. Di(hydrogenated tallow)dimethyl ammonium lauryl sulfate was also prepared by the procedure of Jap. Pat. JA No. 0062998. Accordingly, 200 ml of water and 2 g of nonyl phenol condensed with 40 moles of ethylene oxide were heated to 80° C. 13.3 g of molten Adogen 442 was added while stirring rapidly with a turbine-type stirrer. Then 16.8 g of a 30 percent solution of sodium lauryl sulfate was added while continuing to stir. The mixture was cooled to room temperature with continued high sheer stirring. The product was a low viscosity suspension. The particles were uniformly small, averaging less than 1 micron in diameter.

C. The product of Example 9B was prepared and evaporated to dryness in a thin film. The dried product was a coalesced solid which remain as flakes when mixed at high sheer in water. As per JA No. 0062998, a 10 g portion of the dried flakes was mixed with 20 g of sodium sulfate and ground at high sheer in a Waring Blender to obtain smaller particles. The particle size was then determined by dissolving away the sodium sulfate, and examining the resulting suspension of particles. The particles were found to be about 40 microns in diameter. Thus the preferred process of JA No. 0062998 did not result in particles less than 30 microns.

D. The product of Example 9 B was prepared and after the suspension of small particles had been cooled to room temperature, 30 g of sodium carbonate were added and dissolved. There was no change in the physical appearance of the suspension. The suspension was evaporated to dryness in a thin film. The resulting product was a fine powder. The particle size of the softener was then determined by dissolving away the sodium carbonate, and examining the resulting suspension of particles. The particles were essentially all less than 10 microns in diameter.

Results of laundry tests with the products of Example 9 are shown in Table 3. Example 9 A which is a composition of this invention was highly effective as a softener and as an antistatic agent. Example 9 D, which is a composition of JA No. 0062998 was ineffective both as a softener and as an antistatic agent. Example 9 B which is a composition of neither invention was also ineffective.

EXAMPLE 10

A. Di(hydrogenated tallow)dimethyl ammonium cetyl sulfate was prepared by mixing 148.5 g (0.1 mole) of a 23.2 percent paste of sodium cetyl sulfate in water, 76.5 g (0.1 mole) of Arquad 2HT-75 (75 percent paste in alcohol of di(hydrogenated tallow) dimethyl ammonium chloride from Armak) and 250 g of water, and warming with stirring. At 70° C. the product separated as a soft gel from a clear water phase. The water was decanted and the product, containing 51 percent water, was spread in a thin layer and air dried at room temperature. When it contained less than 5 percent water it was ground in a Waring Blender and screened through a 40 mesh screen. The resulting softener particles were greater than 95 percent between 50 and 400 microns in diameter.

B. Di(hydrogenated tallow)dimethyl ammonium cetyl sulfate was also prepared by the method of JA No.0062998. Accordingly, 200 ml of water and 2 g of lauryl alcohol condensed with 23 moles of ethylene oxide were mixed and heated to 80° C. 40 g of a 25 percent paste of sodium cetyl sulfate was added and dispersed thoroughly. With high sheer stirring using a turbine type stirrer, 20.7 g of molten Arquad 2HT-75 was added in a thin stream. The mixture was cooled slowly to room temperature while continuing to stir with high sheer. The resulting suspension of softener particles was passed through a 325 mesh screen. 56 percent by weight of the particles passed through the screen. The 325 mesh particles ranged from less than 1 micron up to 40 microns in size. The water was removed from the −325 mesh portion by filtration, and the filter cake was dried at room temperature. The particles coalesced on drying and did not redisperse when agitated in water.

C. Di(hydrogenated tallow)dimethyl ammonium cetyl sulfate was prepared as in Example 10 A, except that the paste containing 51 percent water was not dried. 62.5 g of this paste was mixed at high sheer with 70 g of a water soluble liquid ethoxylated propoxylated glycerol monotallowate. Water was evaporated in a thin film at room temperature. The resulting product was an opaque paste which dispersed readily in water. The softener particles in the suspension were mostly between 1 and 5 microns in diameter.

Liquid detergent additives were prepared with the following compositions:

D. 10 parts 50 to 400 micron particles of Example 10 A
20 parts ethoxylated propoxylated glycerol monotallowate
70 parts water E. 30 parts composition of Example 10 C, 1 to 5 micron particles dried into ethoxylated propoxylated glycerol monotallowate
70 parts water F. 20.8 parts composition of Example 10 A as a 51 percent paste in water
20 parts ethoxylated propoxylated glycerol monotallowate
59.2 parts water Laundry tests were run on products from Examples 9 and 10 by the method of Example 1. All were run with 4.5 g of active softener and 100 g of an anionic detergent containing 8.1 percent phosphorus. The wash temperature was 100° F. Liquid detergent additives of Examples 10 D, E, and F were allowed to stand at room temperature for 1 week before they were tested.

TABLE 3

| Product tested | Particle size, μ | Adjuvants | Static, (b) ave. KV | Hand (c) |
|---|---|---|---|---|
| Example 9 A | 50–400 | none | 0.3 | 1.9 |
| Example 9 B | <1 | none | 5.1 | 3.9 |
| Example 9 D | <10 | 9 g sodium carbonate | 7.2 | 3.1 |
| Example 10 A | 50–400 | none | 0 | 2.2 |
| Example 10 C | 1–5 | 9 g nonionic surfactant(a) | 1.4 | 3.3 |
| Example 10 D | 50–400 | 9 g nonionic surfactant(a) | 1.4 | 2.7 |
| Example 10 E | 1–5 | 9 g nonionic surfactant(a) | 7.6 | 3.6 |
| Example 10 F | <1 | 9 g nonionic surfactant(a) | 9.8 | 3.8 |
| None | | | 5.3 | 4.0 |

(a) Ethoxylated propolylated glycerol monotallowate
(b) Static of each piece of cloth is measured with an electro-static voltmeter, and all measurements are averaged.
(c) Hand is the average of at least 4 evaluations, and is rated 1 if equal to a good rinse cycle softener, 2 if very soft but lacking silkiness of rinse cycle softeners, 3 if softer than effect of detergent alone when directly compared, and 4 if equal to the detergent alone. Ratings higher than 3 would not be noticed by consumers.

Compositions of Examples 9 A and 10 A which are preferred compositions of this invention showed excellent softening and antistatic activity. Composition of Example 9 D which is a preferred composition of JA No. 0062998 provided no static protection and softening was inadequate. The composition of Example 10 C which is a suspension of dry 1–5 micron particles in a nonionic surfactant afforded static protection but no softening when added to the wash as an anhydrous product, but on being formulated into a laundry additive containing water (Example 10 E) did not provide either static protection or softening. Example 10 D is a composition of the instant invention and retained antistatic activity and softening on being formulated as a liquid product in water. Examples 9 B and 10 F are not compositions of either the instant invention or JA No. 0062998 in that particles were not dried. They afforded no static protection or softening. Thus the dried particles which are 50–400 microns in diameter remain intact and provide static protection and softening in both powdered and liquid formulations. The preferred particles of JA No. 0062998 do not provide static protection or softening as powders, and their activity in liquids is not stable.

We claim:

1. A particulate laundry softener-antistatic composition wherein the particles are from about 50 to about 500 microns in diameter consisting essentially of a water insoluble, nondispersible undissociated organic salt substantially free from other ingredients and with no water soluble components having the structure $$R_1R_2R_3R_4N^+ \; {}^{-}OSO_2(O)_MR_5 \qquad \text{(i)}$$

wherein $R_1$ is an alkyl, alkenyl, alkoxyalkyl or acylamidoalkyl group containing about 12 to 22 carbon atoms with the alkyl radical or the acylamidoalkyl being ethyl or propyl;

$R_2$ is $R_1$, hydroxyethyl, hydroxypropyl, ethyl, or methyl;

$R_3$ and $R_4$ are methyl, ethyl, propyl, hydroxyethyl, hydroxypropyl, or benzyl;

$R_5$ is an alkyl, alkenyl, alkaryl, or monohydroxyalkyl group containing about 10 to 22 carbon atoms; and x is 0 or 1; (and) or

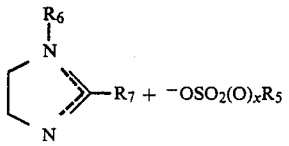

wherein $R_6$ is methyl or ethyl;

$R_7$ is alkyl or alkenyl containing about 14 to 22 carbon atoms; and $R_5$ and x are as defined above.

2. The chemical product of claim 1 which contains less than about 0.25 moles of inorganic salt per mole of said organic salt.

3. The chemical product of claim 1 which contains less than about 25 percent water by weight.

4. The chemical product of claim 1 in which $R_1$ and $R_2$ are the same and are alkyl or alkenyl containing about 16 to 22 carbon atoms.

5. The chemical product of claim 1 in which $R_1$ and $R_2$ are the same and are alkyl or alkenyl containing about 16 to 22 carbon atoms; $R_3$ and $R_4$ are methyl; $R_5$ is alkyl or alkenyl containing about 12 to 22 carbon atoms; and x is 1.

6. The process of preparing the chemical product of claim 1 which consists essentially of the steps of:

i. intimately mixing, in any order, from about 40 to 90 parts of water with about 10 to 60 parts of the combination of:

a. a salt of the sulfate or sulfonate anion and a counter-ion which is substantially ionized in water, and b. a salt of the quaternary ammonium cation and a counter-ion which is substantially ionized in water, the molar ratio of a to b being from about 0.8 to 1 to 1.2 to 1;

ii. allowing the mixture to stand at a sufficient temperature for a sufficient period of time such that the water insoluble organic salt of the sulfate or sulfonate anion and the quaternary ammonium cation separates from the water phase in a form such that it is no more than about 60 percent water by weight, and contains no more than about 0.25 moles of the salt of the counterions per mole of the ion pair of the sulfate or sulfonate anion and the quaternary ammonium cation;

iii. evaporating the trapped water from the sulfate or sulfonate-quaternary ammonium organic salt until it contains less than about 25 percent water by weight; and iv. grinding, spray congealing, or otherwise putting the composition in the form of small particles of 50 to 500 microns in diameter.

7. In a fabric machine washing and drying method, a step for improving the softness and antistatic properties of the laundered fabrics which comprises contacing said fabrics with a product of claim 1 prior to drying said fabrics.

8. The method according to claim 7 in which said contacting step is performed in the wash cycle of said method.

9. The method of claim 8 wherein said product is added to the laundry wash solution in the presence of an optical brightener.

10. The method of claim 8 wherein said product is added to the laundry wash solution in the presence of an anionic detergent.

11. The method of claim 8 wherein said product is added to the laundry wash solution in the presence of a proteolytic enzyme.

12. The method according to claim 7 in which said contacting step is performed during a rinse cycle of said method.

13. The method according to claim 7 in which said contacting step is performed in the drying cycle of said method while said fabrics are damp.

14. A laundry detergent composition comprising an anionic detergent and a product according to claim 1.

15. A composition according to claim 14 containing a proteolytic enzyme.

16. A laundry detergency booster comprising borax and a product according to claim 1.

17. The chemical product of claim 1 entrapped in a detergent compatible solid organic material, in which the ratio of said chemical product to solid organic material is from about 1 to 10 to about 4 to 1.

18. A liquid laundry product containing from about 5 percent to 50 percent of one or more nonionic, anionic, or amphoteric surfactants, from 0 to about 1 percent optical brighteners, from 0 to about 12 percent proteolytic enzymes, from 0 to about 20 percent builder salts, from 0 to about 5 percent polymeric antiredeposition agents, and from about 2 percent to 35 percent of the chemical product of claim 1; the balance being water or one or more mono or dihydric alcohols containing about 2 to 3 carbon atoms, or mixtures thereof.

19. The chemical product of claim 1 in which the particle size is from about 50 to 400 microns.

* * * * *